US005159923A

United States Patent [19]

Kaburaki

[11] Patent Number: 5,159,923

[45] Date of Patent: Nov. 3, 1992

[54] DIVING HELMET

[75] Inventor: Masahiko Kaburaki, Tokyo, Japan

[73] Assignee: Tohgun Kigyo Co., Ltd., Tokyo, Japan

[21] Appl. No.: 710,109

[22] Filed: Jun. 4, 1991

[30] Foreign Application Priority Data

Jun. 14, 1990 [JP] Japan ..... 2-154043

[51] Int. Cl.[5] ..... B63C 11/02

[52] U.S. Cl. ..... 128/201.27; 128/200.29

[58] Field of Search ..... 128/200.29, 201.11, 128/201.27, 201.28

[56] References Cited

U.S. PATENT DOCUMENTS

| | | | |
|---|---|---|---|
| 1,195,793 | 8/1916 | Dunn et al. | 128/201.27 |
| 1,209,224 | 12/1916 | Stelzner et al. | 2/410 |
| 1,935,132 | 11/1933 | Serimgeour | 128/201.27 |
| 2,693,180 | 11/1954 | Galezzi | 128/201.27 |
| 2,988,749 | 6/1961 | Crouzet | 2/205 |
| 3,172,126 | 3/1965 | Spano et al. | 2/2.1 R |
| 3,308,814 | 3/1967 | Wilson | 128/201.27 |
| 3,364,616 | 1/1968 | Speers | 2/2.1 R |
| 3,474,782 | 10/1969 | Cupp | 128/201.27 |
| 3,568,672 | 3/1971 | Cupp | 128/200.29 |
| 4,137,912 | 2/1979 | O'Neill | 128/201.27 |
| 4,527,658 | 7/1985 | Payne | 128/200.29 |

*Primary Examiner*—Edgar S. Burr
*Assistant Examiner*—Aaron J. Lewis
*Attorney, Agent, or Firm*—Zarley, McKee, Thomte, Voorhees & Sease

[57] ABSTRACT

A diving helmet comprises a transparent front window and an air supply chamber at the back. The air supplied from a ship on the water is fed into the helmet through the air supply chamber. The air in the air supply chamber is partially fed to diver's mouth through an air hole formed in the wall of the helmet, thereby preventing the front window from getting misted. The air supply chamber is made as a box separately from the helmet and is embedded therein.

2 Claims, 1 Drawing Sheet

DIVING HELMET

BACKGROUND OF THE INVENTION

This invention relates to a diving helmet.

A known diving helmet comprises a head and a body contacting portion which are made of a heavy metal or synthetic resin with a relatively large thickness to act as diving weight. It comprises a transparent front window, and an air supply tube is connected to the back of the head.

When air is supplied into the helmet, air exhaust noise generates and vibrates in the small space of the helmet to place a diver in uncomfortable condition.

If an air inlet is formed at the back remote from diver's mouth, he will be worried about leakage of fresh air before breathing, if he is a beginner. Further it is necessary to supply fresh low-humidity air to the front window enough to take off mist formed by breathing.

According to the present invention, the above disadvantages will be solved.

According to the present invention, there is provided a diving helmet which comprises a head and a body-contacting portion made of regid material with relatively large thickness to act as weight, the head comprising a transparent front window, an air supply chamber connected with an air supply tube at the back of the helmet, and a plurality of air holes which allow the air supply chamber to communicate with the inside of the helmet, at least one of the air holes being extended close to the front window.

The air supplied into the helmet through the air supply tube is depressurized in the air supply chamber, from which it is fed into the helmet through the air holes. Thus, the exhaust velocity through the air holes becomes lower than that directly from the air supply tube, thereby turning down exhaust noise. The fresh air through the air hole is partially blown to the front window directly, thereby preventing the window from getting misted.

BRIEF DESCRIPTION OF THE DRAWINGS

These and other features and advantages will be seen from the following description with reference to the accompanying drawings, in which.

DESCRIPTION OF PREFERRED EMBODIMENTS OF THE INVENTION

Figure 1:
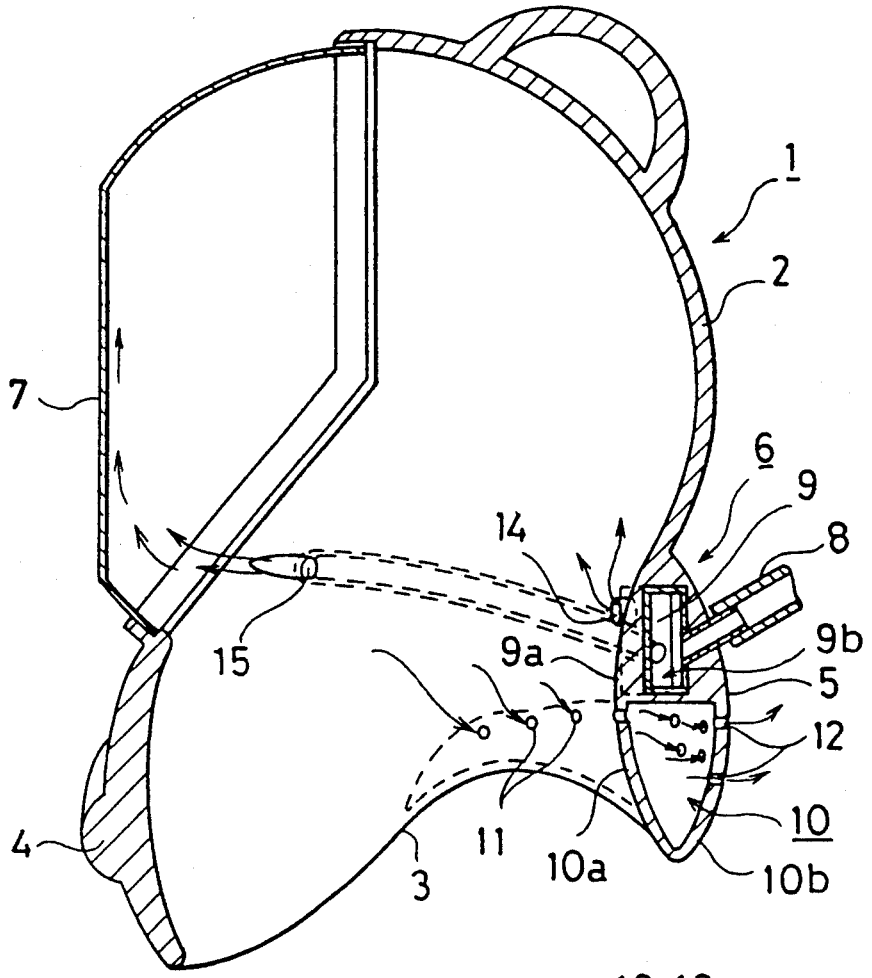
FIG. 1 is a central vertical sectional view which illustrates one embodiment of a diving helmet according to the present invention.

FIG. 1 illustrates one embodiment of the present invention. Numeral 1 denotes a diving helmet in which there is provided a relatively thick, heavy body contacting portion 6 which comprises a head 2, right and left shoulder contacting portions 3, a breast-contacting portion 4 and a neck-contacting portion 5 so that the helmet 1 itself may act as weight. The helmet 1 comprises a front transparent window 7.

An air supply tube 8 is connected to the neck contacting portion 5 at the back of the head 2 of the helmet 1. Air is fed from a ship on the water through the air supply tube so that the helmet 1 may be always filled with fresh air. The helmet 1 is used for underwater walking or sightseeing at relatively small, below 10 m, depth.

At the neck-contacting portion 5 of the lower back portion of the helmet 1, there are provided an air supply chamber 9 which communicates with the air supply tube 8, and an air exhaust chamber 10. The air exhaust chamber 10 has width enough to extend right and left shoulder-contacting portions 3. The front wall 10*a* of the air exhaust chamber 10 has a plurality of air exhaust guide holes 11 horizontally, while the rear wall 10*b* thereof has a plurality of air exhaust holes 12. The air exhaust holes 12 have relatively small diameters, thereby allowing exhausted bubbles to be smaller and keeping exhaust velocity constant. The front wall 9*a* of the air supply chamber 9 has a plurality of openings 14.

There are provided a pair of air holes 15 and 15 from the right and left side walls 9*b* and 9*b* of the air supply chamber 9 to diver's mouth just before the front window 7 through the thick wall of the shoulder-contacting portions 3 and 3. In this embodiment, there are provided a pair of air holes 15 and 15, but one hole 15 may be provided.

It is not so easy to form the air supply chamber 9 integrally with the air exhaust chamber 10, the shoulder-contacting portion 3 and the neck-contacting portion 5 therebelow.

Figure 2:
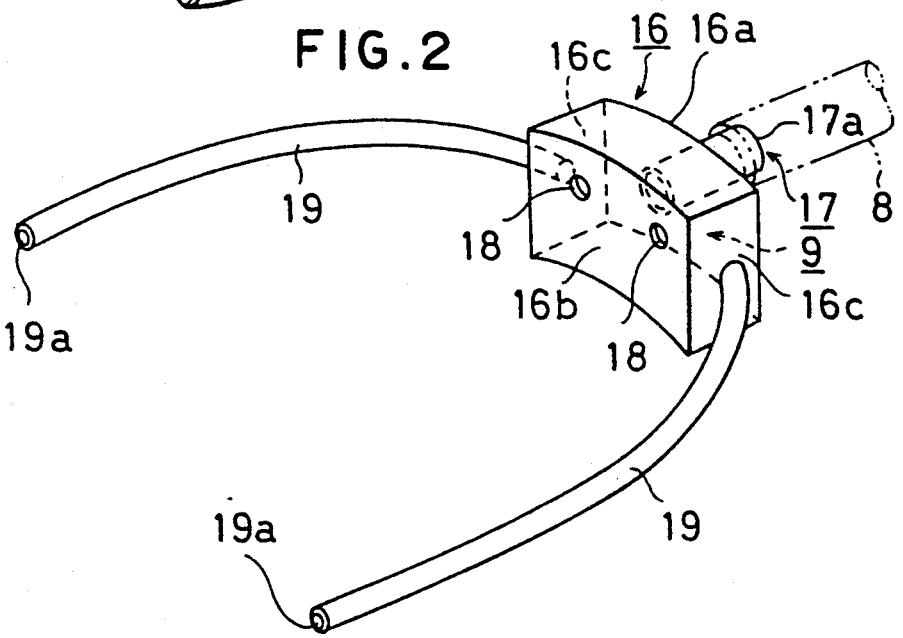
FIG. 2 is a perspective view which illustrates one embodiment of an air supply chamber which is formed separately from the body of the helmet.

Thus, as shown in FIG. 2, the air supply chamber 9 may be formed separately from the helmet body. An air supply chamber 9 is formed in a box 16, the back wall 16*a* of which is connected with a tube 17. A plurality of openings 18 which communicate with the inside of the helmet 1 are provided in the front wall of the box 16. A certain length of air tube 19 is connected with the side wall 16*c* of the box 16. The box 16 is embedded in the thick neck-contacting portion 5 at the back of the helmet 1 so that the outer end 17*a* of the tube 17 may project outwardly and the end 19*a* of the air tube 19 may be positioned just before the window 19. Therefore, the air supply chamber 9 and the air holes can be easily formed.

The advantages of the invention are as follows:

(a) The air fed through the air supply tube 8 is depressurized in the air supply chamber 9 and is supplied into the helmet 1, thereby turning down air supply noise in the helmet.

(b) Fresh air is blown directly through at least one of the air holes to diver's mouth, thereby keeping him reliable if he is a beginner.

(c) The air fed through the air hole is partially blown to the window, thereby preventing the window from getting misted.

The above description merely relates to a preferred embodiment of the present invention, and various changes and modifications are possible without departing from claims as follows.

What is claimed is:

1. A diving helmet which comprises: a head and a body-contacting portion made of rigid material with relatively large thickness to act as weight, the head comprising a transparent front window; an air supply chamber connected with an air supply tube at a back portion of the helmet; an air exhaust chamber which is provided beneath the air supply chamber, a front wall of the air exhaust chamber having an exhaust guide hole, a back wall of the air exhaust chamber having an air exhaust hole; and a plurality of air holes which allow the air supply chamber to communicate with an inside of the helmet, at least one of the air holes being extended close to the front window through the wall of the helmet, the extended air hole opening towards the front window and blowing against the window, thereby taking off blur or mist on the window and enhancing the wearing comfort of said helmet.

2. A diving helmet as defined in claim 1 wherein the air supply chamber is made as a box separately from the helmet such that the box having an opening and an air tube may be embedded in the wall of the helmet, whereby the air tube acts as an air hole which extends close to the front window.

* * * * *